US007736564B2

(12) United States Patent
Sakamoto et al.

(10) Patent No.: US 7,736,564 B2
(45) Date of Patent: Jun. 15, 2010

(54) PROCESS OF MAKING A HIGH STRENGTH POLYOLEFIN FILAMENT

(75) Inventors: Godo Sakamoto, Otsu (JP); Syoji Oda, Otsu (JP); Hiroki Murase, Otsu (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 0 days.

(21) Appl. No.: 11/723,548

(22) Filed: Mar. 20, 2007

(65) Prior Publication Data

US 2007/0190321 A1 Aug. 16, 2007

Related U.S. Application Data

(62) Division of application No. 10/510,565, filed as application No. PCT/JP03/04310 on Apr. 4, 2003, now Pat. No. 7,247,372.

(30) Foreign Application Priority Data

| | | |
|---|---|---|
| Apr. 9, 2002 | (JP) | 2002-106892 |
| Jun. 17, 2002 | (JP) | 2002-176128 |
| Jun. 17, 2002 | (JP) | 2002-176129 |
| Jun. 17, 2002 | (JP) | 2002-176130 |

(51) Int. Cl.
*D01D 5/08* (2006.01)
*D01D 5/16* (2006.01)
*D01F 6/04* (2006.01)

(52) U.S. Cl. ..... 264/210.7; 264/210.8

(58) Field of Classification Search ..... 264/210.7, 264/210.8, 290.5

See application file for complete search history.

(56) References Cited

U.S. PATENT DOCUMENTS

| | | | | |
|---|---|---|---|---|
| 3,962,205 | A | 6/1976 | Ward et al. | |
| 4,228,118 | A | 10/1980 | Wu et al. | |
| 5,278,272 | A | 1/1994 | Lai et al. | |
| 5,302,453 | A * | 4/1994 | Kouno et al. | 428/364 |
| 5,474,845 | A | 12/1995 | Turunen et al. | |
| 5,547,626 | A | 8/1996 | Ohta et al. | |
| 5,906,890 | A * | 5/1999 | Taniguchi et al. | 428/364 |
| 6,605,348 | B1 | 8/2003 | Ohta et al. | |
| 6,689,462 | B2 | 2/2004 | Ohta et al. | |
| 6,899,950 | B2 | 5/2005 | Sakamoto et al. | |
| 7,056,579 | B2 | 6/2006 | Sakamoto et al. | |
| 7,141,301 | B2 | 11/2006 | Sakamoto et al. | |

FOREIGN PATENT DOCUMENTS

| | | | |
|---|---|---|---|
| EP | 1445356 | A | 8/2004 |
| GB | 1592936 | A | 7/1981 |
| JP | 58-18343 | | 4/1983 |
| JP | 60-47922 | | 10/1985 |
| JP | 62-257414 | | 11/1987 |
| JP | 3-260110 | A | 11/1991 |
| JP | 6-228809 | | 8/1994 |
| JP | 2510671 | | 4/1996 |
| JP | 8-504891 | | 5/1996 |
| JP | 11-269717 | | 10/1999 |
| JP | 2963199 | B2 | 10/1999 |
| JP | 2003-49320 | A | 2/2003 |
| JP | 2003-55833 | A | 2/2003 |
| JP | 2003-64525 | A | 3/2003 |
| JP | 2003-96617 | A | 4/2003 |
| WO | WO-01/12885 | A | 2/2001 |
| WO | WO-03/014437 | A | 2/2003 |

OTHER PUBLICATIONS

Randall, J. C. (1989). "Ethylene-Based Polymers," *Journal of Macromolecular Science C: Reviews in Macromolecular Chemistry and Physics* C29(2&3):285-297.

* cited by examiner

*Primary Examiner*—Leo B Tentoni
(74) *Attorney, Agent, or Firm*—Morrison & Foerster LLP

(57) ABSTRACT

A filament having excellent incision resistance includes as a primary component a polyethylene filament having a weight-average molecular weight of 300,000 or less and a ratio of a weight-average molecular weight to a number-average molecular weight (Mw/Mn) of 4.0 or less as determined in the state of a filament as well as a modulus of 500 cN/dtex or more. This filament is useful to produce a fabric excellent in incision resistance, a fibrous material for reinforcing mortar or concrete, and a rope, each of which comprises the filament. The filament can be produced by drawing a non-drawn polyolefin filament which comprises a polyethylene having a weight-average molecular weight of 60,000-600,000, a ratio of a weight-average molecular weight to a number-average molecular weight (Mw/Mn) of 4.5 or less, and a rate of birefringence ($\Delta n$) of 0.008 or more, at a temperature not higher than the $\alpha$-relaxation temperature of the non-drawn filament.

21 Claims, No Drawings

PROCESS OF MAKING A HIGH STRENGTH POLYOLEFIN FILAMENT

REFERENCE TO RELATED APPLICATION

This application is a division of Ser. No. 10/510,565, filed Oct. 8, 2004, now U.S. Pat. No. 7,247,372, which was a national stage application under 35 USC 371 of International Application No. PCT/JP03/04310, filed Apr. 4, 2003, which claimed the priority of Japanese Patent Application Nos. P2002-106892, filed Apr. 9, 2002, P2002-176128, filed Jun. 17, 2002, P2002-176129, filed Jun. 17, 2002, and P2002-176130, filed Jun. 17, 2002, the entire contents of which are incorporated herein by reference.

FIELD OF THE INVENTION

The present invention relates to a filament excellent in incision resistance and textiles comprising said filament, as well as incision-resistant gloves, vests comprising said filament; fibrous materials for reinforcing cement mortar or concrete; and a variety of ropes. The present invention also relates to a process for producing a high strength polyolefin filament and a high strength polyolefin filament obtained therefrom.

BACKGROUND OF THE INVENTION

Conventionally, natural fibers (such as cotton) and the general organic fibers have been used as an incision-resistant material. Gloves made by knitting up those fibers etc. have been often used in the field which needs incision-resistant.

Then, knits, textiles, etc. which consist of spun filament of high strength filaments, such as an aramid fiber, for providing the incision-resistant function have been devised. However, there was dissatisfaction in the viewpoint of a hair omission or durability. Although trials which improve incision-resistance by on the other hand using metal fibers together with organic fibers or natural fibers as another means are performed, the drape of textures becomes hard by using metal fibers, and there is thus a problem that pliability is impaired.

For example, the fiber reinforced concrete which is made by kneading metal fibers, glass fibers, carbon fibers, polyvinyl alcohol fibers, or various olefin fibers to various cement mortar or concrete materials is developed as a method of improving the brittleness which is a defect in the structure material of cement mortar and concrete (for example, JP-B-58-18343, Japanese patent No. 2,510,671). However, although the reinforcing effect by adhesion with a concrete matrix is excellent, the fibers for these reinforcement, such as metal fibers represented by steel fibers, essentially have large specific gravity which results in a defect that a structure made thereof becomes heavy, and in addition, the strength of the structure is degraded due to generation of rust. Therefore, the fibers are unsuitable as structure material for such as harbor facilities or skyscrapers asked for a weight saving.

On the other hand, for inorganic fibers, glass fibers have an inferior in alkali resistance and carbon fibers have a problem in that the fibers become bended or cut during kneading. In addition, polyvinyl alcohol fibers or polyolefin fibers, especially polypropylene fibers which are organic fibers, are low in tenacity, and thus have a problem of reduction in slump due to a need to increase the incorporation of the fibers to a large extent for achieve a sufficient effect. Although polyethylene fibers with ultra-high molecular weight are excellent in strength or alkali resistance, the fibers have a problem in that stiffness of the fibers is low and they easily get twined with each other to become a lump during kneading due to the flatness of the cross section.

Conventionally, twists of synthetic filaments, such as vinylon, polyester filament, and nylon, have mainly been used for a rope. In recent years, although a monofilament of fluorocarbon or nylon, as well as the interlace of a nylon monofilament came to be used for the rope, the rope of the interlace structure of a nylon monofilament had an inadequate tensile strength and thus was sometimes broken in the ocean area especially with wild waves. In addition, an improvement was desired also in respect of wear resistance and durability. Further, since the tensile strength was not high enough, the rope itself should be thick inevitably and the nature for containment and handling were remarkably bad.

As a polyethylene filament with a high strength, there is known a filament which is produced from an ultra-high molecular weight polyethylene by a so-called "gel-spinning method and melt spinning" and which has such a high strength and such a high elastic modulus that any of conventional filaments has never possessed, as disclosed in JP-B-60-47922 and JP-A-62-257414 for example, and this filament has already come into industrially wide use.

A high strength polyolefin filament produced by melt spinning is disclosed in, for example, U.S. Pat. No. 4,228,118. According to this patent, the process for producing a high strength polyethylene filament disclosed comprises extruding a polyethylene having a number-average molecular weight of at least 20,000 and a weight-average molecular weight of less than 125,000 through a spinneret which is maintained at the temperature between 220 and 335° C., then taking over the polymer at the rate of at least 30 m/min. followed by drawing it at least 20 times at the temperature between 115 and 132° C. Thus the filament has a tenacity of at least 10.6 cN/dTex.

Moreover, JP-A-08-504891 discloses a high strength polyethylene filament which is produced by melt spinning polyethylene with high density through a spinneret, and then drawing the obtained fiber at the temperature of 50-150° C. The process for production is characterized in that the polyethylene provided for melt spinning is a homopolymer of ethylene which satisfies the conditions of having a weight-average molecular weight (Mw) of 125,000 to 175,000, a number-average molecular weight (Mn) of 26,000 to 33,000 and a polymer dispersibility (Mw/Mn) of less than five, as well as a density of larger than 0.955 g/cm$^3$, and that the extent of draw ratio at the draw stage is at least 400%. This patent is characterized by controlling the polymer dispersibility and the density of polyethylene as a starting material to the above-mentioned value.

In addition, JP-A-11-269717 discloses a high strength polypropylene filament made from a crystalline polypropylene with a weight-average molecular weight of 200,000 to 450,000, although the tenacity of the high strength polypropylene filament obtained according to the patent is at most about 13 cN/dtex. This patent is characterized by blending two kinds of polypropylene as starting materials each of which has a different melt flow rate, performing melt spinning, and drawing said filament to 5 times or more under the draw temperature of 120-180° C., using a pressurized steam.

Production cost becomes very high from the industrial viewpoint since a mixture of a solvent and a polymer is used in gel-spinning and solution-spinning. That is, by the method currently disclosed in this patent, the concentration of polyethylene as a starting material is at most 50% or less, and thus is lacking in productivity. If a solvent is used, incidental facilities, such as an equipment for recovery/purification and the like, will certainly be needed, which is thus expensive. Additionally, it is not desirable in respect of environment.

Furthermore, with respect to a melt spinning, although some arts are known, a high strength of said filament is attained only by the very limited conditions for production.

SUMMARY OF THE INVENTION

The first purpose according to the present invention is to develop a new polyethylene filament which has the outstanding incision-resistance and to provide incision-resistant textiles comprising said filament as well as incision-resistant gloves, vests comprising said filament.

The second purpose according to the present invention is to provide a filament for reinforcing cement mortar or concrete and fibrous materials which are light and excellent in alkali resistance, and which are also excellent in flexural strength, durability, toughness, and moisture-proof.

The third purpose according to the present invention is to provide a new polyethylene filament rope which has a high strength and has a high rate of retention of strength in a humid condition.

The fourth purpose according to the present invention is to provide a process for producing a high strength polyolefin filament without using a mixture of a solvent and a polymer like gel-spinning or solution-spinning for the above-mentioned application and use of the filament.

These inventors came to complete this invention at last, as a result of addressing and solving the above-mentioned problems.

A polyethylene filament having a tensile strength of 15 cN/dtex or more and a tensile modulus of 500 cN/dtex or more is provided. The index value of a Circular knit comprising the polyethylene filament may be 3.0 or more as determined by using a coup tester. The polyethylene filament may include a polyethylene having a weight-average molecular weight of 300,000 or less and a ratio of a weight-average molecular weight to a number-average molecular weight (Mw/Mn) of 4.0 or less as determined in the state of a filament. The polyethylene filament can be used to form a polyethylene filament fabric excellent in incision resistance, a incision-resistant glove, a incision-resistant vest, and the like.

High strength polyethylene filaments may be used as a primary component of a fibrous material for reinforcing cement mortar or concrete. The high strength polyethylene filament may a monofilament fineness of 1.5 dtex or less. The filament may be a chopped filament. The filament may be in the form of a chip which converges two or more high strength polyethylene filaments cut into suitable length. A concrete composition may include the chip. In addition, a rope may be formed with polyethylene filaments with a tensile strength of 15 cN/dtex or more and a tensile modulus of 500 cN/dtex or more. The polyethylene filaments may be formed with a polyethylene having a weight-average molecular weight of 300,000 or less and a ratio of a weight-average molecular weight to a number-average molecular weight (Mw/Mn) of 4.0 or less as determined in the state of a filament. The polyethylene may contain from 0.01 to 3.0 branch chains per 1,000 backbone carbon atoms.

Also provided is a process for producing a high strength polyolefin filament. In this process, a non-drawn polyolefin filament containing a polyethylene having a weight-average molecular weight of 60,000-600,000, a ratio of a weight-average molecular weight to a number-average molecular weight (Mw/Mn) of 4.5 or less, and a rate of birefringence ($\Delta n$) of 0.008 or more may be drawn at a temperature not higher than the $\alpha$-relaxation temperature of the non-drawn filament. The total draw ratio from spinning to drawing may be 1500 times or more. In addition, the polyolefin may be a polyethylene composed essentially of ethylene. One or more drawing steps may be conducted after the drawing at a temperature not higher than the $\alpha$-relaxation temperature. The process may be used to obtain a high strength polyolefin filament having an average tensile strength of 15 cN/dtex or more and an average tensile modulus of 500 cN/dtex.

Hereafter, this invention is explained in full detail.

In the process for producing a filament excellent in incision resistance according to the present invention and a filament or a fibrous material for reinforcing cement mortar or concrete, it is necessary to employ a deliberate and novel process. For example, the following process is recommended; however, this process should not be construed as limiting the scope of the present invention in any way.

Polyethylene as a starting material referred to in the context of the present invention is a polyethylene of which the repeating unit is substantially ethylene, or it may be copolymerized with a small amount of other monomer such as an $\alpha$-olefin, an acrylic acid and derivatives thereof, an methacrylic acid and derivatives thereof, a vinyl silane and derivatives thereof, and the like. The polyethylene as a starting material may be a blend between such copolymers, a copolymer with an ethylene homopolymer, a blend with a homopolymer based on the other monomer such as an $\alpha$-olefin. Preferably, a copolymer with an $\alpha$-olefin, such as propylene and butene-1 in particular, is used to introduce the branch with a long chain to some extent so that a stability for producing a filament is imparted in the production of the present filament, especially in the process of spinning or drawing.

However, if the quantity of long chain branch increases too much, it becomes a defect and the strength of fiber falls. Therefore, it is desirable that branched chains containing at least 5 carbon atoms are present at a rate of 0.01 to 3 per 1,000 backbone carbon atoms from a viewpoint of obtaining a filament with high strength and a high elastic modulus. Preferably, the rate ranges from 0.05 to 2, more preferably from 0.1 to 1 per 1,000 backbone carbon atoms.

Also, it is important that the polyethylene in the state of a filament has a weight-average molecular weight of 300,000 or less, and that the ratio of a weight-average molecular weight to a number-average molecular weight (Mw/Mn) becomes 4.0 or less. Preferably, it is important that a weight-average molecular weight in the state of a filament is 250,000 or less, and that the ratio of a weight-average molecular weight to a number-average molecular weight (Mw/Mn) becomes 3.5 or less. Still more preferably, a weight-average molecular weight in the state of a filament is 200,000 or less, and that the ratio of a weight-average molecular weight to a number-average molecular weight (Mw/Mn) becomes 3.0 or less.

When a polyethylene of a degree of polymerization with which a weight-average molecular weight of the polyethylene in the state of a filament exceeds 300,000 is used as a starting material, the melt viscosity becomes very high, and therefore, the melt molding thereof becomes very hard. In addition, when the ratio of the weight-average molecular weight to the number-average molecular weight of the polyethylene in the state of a filament is at least 4.0, this polyethylene filament is lower in the largest draw ratio in drawing and also lower in strength, as compared with a case using a polymer having the same weight-average molecular weight. The reasons therefore may be assumed that the molecular chain with long relaxing time can not be fully drawn in the drawing step and finally breaks, and that its wider molecular weight distribution permits the amount of a component with a lower molecular weight to increase to thereby increase the number of the molecular ends, which lowers the strength of the resultant filament, as compared with a polyethylene having the same weight-average molecular weight. In addition, the polymer may be intentionally deteriorated in the step of melt extrusion or spinning so as to control the molecular weight and the molecular weight distribution of the polyethylene in the state of a filament; or otherwise, a polyethylene having a narrow molecular weight distribution may be used.

In the method preferable for producing the polyethylene filament according to the present invention, polyethylene mentioned above is melt-extruded by an extruder, quantitatively discharged through a spinneret with a gear pump. The resultant threadlike polyethylene is then quenched with a cooled air, and drawn at a predetermined speed. In the spinning step, it is important that the threadlike polyethylene is drawn quickly enough. In other words, it is important that the ratio of the velocity of the fluid product issuing from the spinneret and the spinning speed is at least 100, preferably at least 150, more preferably at least 200. This ratio can be calculated from the diameter of the mouthpiece, the discharge amount from a single hole, the polymer density in the molten state, and the spinning speed.

It is very important that the filament mentioned above is further subjected to the drawing method shown below. Thus, it was found that the physical properties of a filament were surprisingly improved by drawing the filament at a temperature which is less than the $\alpha$-relaxation temperature of the filament, and then further drawing at a temperature which is higher than the $\alpha$-relaxation temperature of the filament and lower than the melting point of the same filament. In this case the filament may be drawn further in multi-stages.

In the present invention, a predetermined fiber was obtained by fixing the speed of the first set of a godet roller with 5 m/min, whereas varying the speed of the other godet rollers on the occasion of the drawing process.

It is possible to make into fabric the polyethylene filament obtained above by using a known method. The fabric according to the present invention may not bar incorporating other filaments as well as the case of only the filaments which consist of a primary component of the base filament which constitutes the fabric, and may comprise any other synthetic filaments or natural filaments depending on a design or function.

It is possible to make into an incision-resistant glove or vest by using a known method similarly. The incision-resistant glove or vest according to the present invention may not bar incorporating other filaments as well as the case of only the filaments which consist of a major component of the base filament which constitutes the glove or vest, and may comprise any other synthetic filaments or natural filaments depending on a design or function.

The fibrous material based on the chopped filament in accordance with the present invention for reinforcing cement mortar or concrete can be obtained by cutting the obtained filaments into predetermined length. Especially the chopped filament is effective in a use for reinforcing mortar, and desirably, it has a cut length of 30 mm or less. When it has a cut length of more than 30 mm, it is not preferable from a viewpoint of homogeneity since the filaments becomes balky (fiber ball) during kneading. Here, for a mortar reinforcement use, a mixture of filaments with sand and cement, which is called a premix, is often used. It turns out that the characteristics of filaments can be demonstrated more effectively as filaments become distributed more uniformly, when producing a premix. It is thought that each one of the filaments can contribute to the reinforcement effect since the filament of the present invention has a circular cross-section shape and has almost no fusion or sticking by pressure, and that each one of the filaments has the feature that it can easily distribute uniformly due to its stiffness.

The fibrous material based on monofilament-type organic fiber for reinforcing cement mortar or concrete can be obtained by lengthening and arranging the obtained filaments with predetermined thickness, binding each filament by using a sizing agent or heat fusion fibers, and then cutting into predetermined length. Especially, monofilament-type organic filaments are particularly effective in a concrete reinforcement use. It is preferred to choose resins excellent in alkali resistance as such sizing agents which include thermosetting resins, such as an epoxy resin and a phenol resin, thermoplastic resins, such as an ethylene based resin, a urethane resin, and an acrylate resin. As such heat fusion fibers, fibers having a skin-core structure with a melting point of the skin portion of 120° C. or less or fibers with a melting point of the whole fiber of 120° C. or less can be selected. Thus, the monofilament-type organic filaments obtained are used by cutting them into chips with suitable length. It is preferred to arrange the cut length of the chips from once to twice based on the diameter of the maximum coarse aggregate. In the case of monofilament-type organic filaments, in order for a resin to make adhere to the filaments for sizing, the content of resins with a lower reinforcement effect is preferred to be as small as possible. Since the filament according to the present invention has a circular cross-section shape, the effect that the resin uniformly adheres to the filament can be expected.

When sizing the filaments with heat fusion filament etc., the method of covering the filaments according to the present invention with the heat fusion filament is mentioned. Also in this design, filaments with a circle cross-section are more effective in making its surface area small and thus smaller in absorbing water rather than filaments with a modified cross-section, so that the effect that slump loss also becomes small can be expected. When using the filament for mortar, it is preferred to use the filament by the length of 30 mm or less.

As for the concrete composition according to the present invention, cement may be any one generally used and includes Portland cement, early-strength cement, etc. As for water, sand, and gravel, without limiting especially to an area or a kind, any water, sand, or gravel generally used may be suitable. Fly ash and fine powder of blast-furnace-slag can also be used, by choosing them suitably.

It is possible to make the polyethylene filament obtained above into a rope by using the existing method. The rope according to the present invention may not bar incorporating other filaments as well as the case of only the filaments which consist of a primary component of the base filament which constitutes the rope, and may be coated around with any other materials, such as a polyolefin, polyurethane, and the like with a low molecular weight, depending on a design or function.

The form of a rope may be a twist structure of 3-strand laid, 6-strand laid or the like, a cloth structure of 8-strand laid, 12-strand laid, Braid-on-Braided or the like, a double braid structure where a core part is coated around spirally with filament, Strand, and the like. An ideal rope is designed depending on a use or performance.

Next, the manufacturing process of the filaments according to the present invention is explained.

The filaments according to the present invention may be obtained by melt-spinning a polymer with a weight-average molecular weight of 60,000-600,000, and a ratio of a weight-average molecular weight to a number-average molecular weight (Mw/Mn) of 4.5 or less at the ratio of the spinning speed to the velocity of the fluid product issuing from the spinneret (draft ratio) such that the rate of birefringence (Δn) becomes 0.008 or more, and then drawing the non-drawn filament obtained at the temperature below the α-relaxation temperature of the non-drawn filament.

More specifically, in the process according to the filaments, it is important that the weight-average molecular weight of a polymer is 60,000-600,000 and it is important that the ratio (Mw/Mn) of a weight-average molecular weight to a number-average molecular weight is 4.5 or less. Preferably, it is important that the weight-average molecular weight of a polymer is 60,000-300,000, and it is important that the ratio (Mw/Mn) of a weight-average molecular weight to a number-average molecular weight is 4.0 or less. More preferably, it is important that the weight-average molecular weight of a polymer is 60,000-200,000, and it is very important that the ratio (Mw/Mn) of a weight-average molecular weight to a number-average molecular weight is 3.0 or less.

The polymer in the present invention is characterized by a polyethylene which the repeating unit is substantially ethylene. Such a polyethylene can be polymerized, without limitation, using a metallocene catalyst as disclosed in Japanese Patent No. 2963199.

When the weight-average molecular weight of a polymer as a starting material is less than 60,000, such a material is easy to be melt-molded, but the resultant filament is poor in strength because of the low molecular weight. On the other hand, when a polymer as a starting material has a weight-average molecular weight of more than 600,000 or more, the melt viscosity of such a high molecular weight polymer becomes very high, and therefore, the melt molding thereof becomes very hard. In addition, when the ratio of the weight-average molecular weight to the number-average molecular weight of the polymer in the state of a filament is 4.5 or more, the obtained filament is lower in the largest draw ratio in drawing and also lower in strength, as compared with a case using a polymer having the same weight-average molecular weight. The reasons therefor are assumed that the molecular chain with long relaxing time can not be fully drawn in the drawing step and finally breaks, and that its wider molecular weight distribution permits the amount of a component with a lower molecular weight to increase to thereby increase the number of the molecular ends, which lowers the strength of the resultant filament.

In the present invention, the process for obtaining a high strength polyolefin filament was invented from the above polymers by studying intensively. The process will be described. Polymer mentioned above is melt-extruded by an extruder and is quantitatively discharged through a spinneret with a gear pump. The resultant threadlike polymer was then quenched and solidified with a cooled air at the ratio of the spinning speed to the velocity of the fluid product issuing from the spinneret (draft ratio) such that the rate of birefringence (Δn) becomes 0.008 or more, preferably 0.010 or more, more preferably 0.014 or more, so as to come out a non-drawn filament. The procedure mentioned is important. More specifically, it is important that the ratio of the spinning speed to the velocity of the fluid product issuing from the spinneret is 100 or more, preferably 150 or more, more preferably 200 or more. This ratio can be calculated from the diameter of the mouthpiece, the discharge amount from a single hole, the olefin polymer density, and the spinning speed.

Subsequently, although it is important to draw the obtained non-drawn filament at the temperature below the α-relaxation temperature of the filament at least, and then to perform one or more step drawing for this one-step drawn filament at the temperature not less than the α-relaxation temperature, it is very important at this time to make preferably the total draw ratio from spinning to drawing into 1500 times or more, more preferably 2000 times or more, still more preferably 3000 times or more. It was found that the physical properties of filaments are surprisingly improved by adopting such drawing conditions. In this drawing step, although non-drawn filaments once wound up may be subjected to the drawing step, they may be subjected directly to the drawing step without winding them up at the spinning step. The drawing method is not limited in a particular way. Any methods known in the art, for example, roller drawing, radiation panel drawing, steam jet drawing, pin drawing, etc. are recommended, although not being limited to them.

The absorption which is generally observed at the highest temperature side of the oriented polyethylene is known as the α-relaxation, which is considered to be involved directly in thermal motion of molecular chains in the crystal phase. This α-relaxation temperature can be determined by measuring dynamic viscoelasticity thereof. More specifically, the α-relaxation temperature is an absorption which appears at the highest temperature side when a loss tangent is calculated from a storage elastic modulus and a loss elastic modulus obtained by the measurement, and then these three values obtained at each temperature are plotted in logarithmic (ordinate axis) against temperature (transverse axis).

It is indicated in a number of documents, such as U.S. Pat. No. 4,228,118, JP-A-8-504891, JP-5-186908, etc., that it is preferred in terms of physical properties and productivity to heat and draw the filament at the temperature of at least 50° C. or more when drawing polyolefin filament. However, surprisingly in the present invention, it was found that physical properties of the filament could be remarkably improved by drawing the filament under the temperature condition of not higher than the α-relaxation temperature of the filament, which is in disagreement with the known art. And thus the present invention was accomplished.

Accordingly, it is desirable that the drawing is carried out at a temperature not higher than the α-relaxation temperature of the non-drawn filament, specifically at 65° C. or less, and that further drawing is carried out at a temperature which is higher than the α-relaxation temperature of the non-drawn filament and lower than the melting point of the same filament, specifically at 90° C. or more. It is very important to carry out the first-step drawing preferably at a temperature which is at least 10 degrees lower, more preferably at a temperature which is at least 20 degrees lower, than the α-relaxation temperature of the non-drawn filament. It is also important to carry out the drawings after the second-step drawing preferably at a temperature which is at least 20 degrees higher, more preferably at a temperature which is at least 30 degrees higher, than the α-relaxation temperature of the filament.

Although the reasons why physical properties of a filament is improved by carrying out the first-step drawing at a temperature not higher than the α-relaxation temperature of the non-drawn filament is not certain, they are assumed as follows. That is, larger drawing tension is applied to the filament by drawing at a temperature not higher than the α-relaxation temperature of the filament. In addition, it is hard for the crystal itself to move by the drawing since the drawing is carried out at a temperature not higher than the α-relaxation temperature of the filament, and thus drawing of only an amorphous portion is mainly performed. That is, it never happens easily that the molecular chains are pulled out of the crystal region as is happen in the case of ultra-drawing. As the result, it is assumed that the structure where drawings after the second-step can be performed smoothly forms in the filament, the drawings after the second-step are performed smoothly, and thus physical properties of the filament after drawing are improved, although it is not certain for details.

Even more than the drawing temperature, it is very important in the present invention to make the rate of birefringence of non-drawn filament (Δn) to be high, i.e., to promote molecular orientation more. It is assumed that the first-step drawing and the drawings after the first-step drawing can be performed more smoothly by making the molecules highly orientated.

DETAILED DESCRIPTION OF THE INVENTION

Although the invention is explained in detail in the foregoing by using examples, the invention is not limited by the following examples in any way and variations can be properly made therein as far as they can be in conformity to the scope described. And they are within the scope of the invention.

Hereinafter, the method of measurement and the measuring conditions in relation to the characteristic values according to the present invention will be explained below.

(Tenacity and Elastic Modulus)

The tenacity and the elastic modulus of a sample, of the present invention, with a length of 200 mm (the distance between each of chucks) were measured as follows. The sample was drawn at a drawing speed of 100%/min., using "Tensilon" (Orientic Co., Ltd.). A strain-stress curve was recorded under an atmosphere of a temperature of 20° C. and a relative humidity of 65%. The tenacity of the sample (cN/dTex) was calculated from a stress at the breaking point of the curve, and the elastic modulus (cN/dTex) was calculated from a tangent line which shows the largest gradient at or around the origin of the curve. The respective values were measured 10 times, and the 10 measured values were averaged.

(Weight-Average Molecular Weight Mw, Number-Average Molecular Weight Mn and Ratio of Mw/Mn)

The values of the weight-average molecular weight Mw, the number-average molecular weight Mn, and the ratio of Mw/Mn were measured by gel permeation chromatograph (GPC). As the apparatus for GPC, GPC 150C ALC/GPC (manufactured by Waters) equipped with one column (GPC UT802.5 manufactured by SHODEX) and two columns (UT806M) was used. As a solvent for use in measurement, o-dichlorobenzene was used, and the temperature of the columns was set at 145° C. The concentration of the sample was 1.0 mg/ml, and it was measured by injecting 200 μl of the sample. The calibration curve of the molecular weight was found by the universal calibration method, using a polystyrene sample having a known molecular weight.

(Dynamic Viscoelasticity Measurement)

Dynamic viscosity measurement in the present invention was performed using the "Reo-Vibron DDV-01FP type" (manufactured by Orientic Co., Ltd.). Filaments are divided or doubled so as to become 100 deniers±10 deniers as a whole, with making the arrangement of each monofilament as uniformly as possible, both the ends of fiber being wrapped in aluminum foil and pasted up by the cellulosic adhesive so that a measurement length (distance between metallic chucks) may be set to 20 mm. The overlap width in this case may be about 5 mm in consideration of fixation with metallic chucks. Each specimen was carefully installed to the metallic chucks set as an initial width of 20 mm so that the fiber might not be slackened or twisted. This experiment was conducted after giving a preliminary modification for several seconds under the temperature of 60° C., and the frequency of 110 Hz beforehand. In this experiment, temperature distribution was determined on the frequency of 110 Hz from the low temperature side at the increasing rate of about 1° C./min. for the temperature span between −150° C. to 150° C. In the measurement, a static load was set as 5 gf, and the automatic regulation of the sample length was carried out so that fiber might not slacken. The amplitude of dynamic modification was set as 15 micrometers.

(Ratio of a Velocity of the Fluid Product Issuing from the Spinneret and a Spinning Speed (Draft Ratio))

A draft ratio (Ψ) is given by the following formula.

Draft ratio (Ψ)=a spinning speed (Vs)/a velocity of the fluid product issuing from the spinneret (V)

(Preparation of Samples for Measuring Incision Resistance)

Base filaments with 440 dtex±40 dtex were prepared and the 100 filaments to be measured were knitted up by using a circular knitting machine. Sampling was performed by selecting the part having no cast-off filament (Itotobi) and cutting the knit to the size of 7 cm×7 cm square or larger. When the test was conducted, one piece of cartridge paper was put under the sample since the mesh of the knit was rough. The portion to be measured, which was the outer part of the circular knit, was set so as to form an angle of 90 degrees to the mesh direction.

(Measurement of Incision Resistance)

A coup tester was used for evaluation. This apparatus is characterized in that a round blade runs on the sample with rotating in a direction opposite to the running direction and gets the sample cut, and that the aluminum foil exists on the back of the sample at the point where the cutting is over, and that the completion of the cutting test is detected when the electric conduction is permitted by a contact between the round blade and the aluminum foil which is existed on the back of the sample. The counting is conducted by a counter equipped with the apparatus at all times while the cutter is operating. The counted valued is recorded.

This test is conducted by evaluating incision level of a test sample in comparison with a flat-woven cotton cloth with a mass (METSUKE) of about 200 g/m$^2$ as a control. The test is started with a control, a control and a test sample being tested by turns, one set of the test is over when the test sample is tested five times and the sixth test for the control is performed.

The evaluated value calculated here is referred to as "Index", which is calculated in accordance with the following formulas.

$A$={(a count value of the cotton cloth before tested)+(a count value of the cotton cloth before tested)}/2

Index=(a count value of the sample+$A$)/$A$

The cutter used in this evaluation was a 45 mm ϕ for rotary cutter L type manufactured by OLFA Corporation. The quality of the material was tungsten steel SKS-7 with a blade thickness of 0.3 mm.

The evaluation was conducted with applying a load of 320 g at the test.

(Bend Test for Mortar)

Water was mixed to a premix material with maximum fiber content obtained in the dispersibility test for mortar premix to become a water/cement ratio of 45% and then the mixture obtained was stirred for two minutes. The mortar paste was made into a test piece having a size of 10×10×40 (cm). Curing period was set to be 14 days. Four-point bending test with each span of 30 cm was conducted under the condition that the rate of deflection was 1/1500 of the span. To evaluate the effects of the filaments, the load values at the position where 2 mm of deflection was observed at the center point was compared with each other. And thus tenacity performance of the filament was determined.

(Slump Test)

An organic fiber of monofilament type is obtained by converging (sizing) the filaments according to the present invention with a resin or a heat fusion fiber. To perform the slump test, fine aggregates were stirred with cement for 1 minute, coarse aggregates with a maximum diameter of coarse aggregate of 20 mm and water were further added to be kneaded for 2 minutes, and then an organic fiber of monofilament type and a water-reducing agent were added, so as to prepare a concrete paste. Each compounding ratio was as follows: water/cement ratio was 50%, fine aggregate ratio was 50%. A unit quantity of water was 190 kg/m$^3$, a maximum diameter of coarse aggregate was 20 mm, a mixing content of the filament was 1 volume %, and 2% of a water-reducing agent of polycarboxylic acid type was added based on the content of cement. The slump test was performed in accordance with JIS-A1101.

(Bend Test for Concrete)

The concrete paste obtained in the slump test was made into a test piece having a size of 10×10×40 (cm) in accordance with the test method described in JCI-SF4 "Test method of bending strength and bending toughness for fiber-reinforced concrete". Curing period was set to be 28 days. Four-point bending test with each span of 30 cm was conducted under the condition that the rate of deflection was 1/1500 of the span. Maximum flexural strength and 2 mm-reduced flexural strength were evaluated as evaluation items.

(Rate of Birefringence)

Measurement of a rate of birefringence according to the present invention was conducted by using "OPTIPHOT-POL" manufactured by Nikon Corporation. Seal liquid (cedar oil or liquid paraffin) was dropped on the slide. The sample cut at the angle of 45 degrees to the fiber axis with a length of 5 to 6 m is immersed into the liquid, with the cutting plane being turned up. The sample slide glass is put on a rotation stage. An analyzer is inserted, with adjusting so that a scale and a filament may become parallel, to be made a dark field of view. After that, a compensator is set to 30 and the number of stripes is counted. Then, the scale "a" of the compensator of the point that the sample becomes the darkest when the compensator is turned in the direction from 30 to 40 and the scale "b" of the compensator of the point that the sample becomes the darkest first when the compensator is turned in the opposite direction. After that, the compensator is returned to 30 and an analyzer is removed, and then the diameter "d" of the sample is measured. After repeating the above measurement several times, a rate of birefringence (Δn) is calculated based on the following formulas.

$$\Delta n = \Gamma / d$$

$$\Gamma \text{ (retardation)} = n\lambda_0 + \epsilon$$

$$\lambda_0 = 589 \text{ nm}$$

ϵ: obtained from C/10000 (apparatus constant=0.816) and "i".

$$i = (a - b)$$

(Total Draw Ratio)

The total draw ratio from spinning to drawing is given by the following formulas.

Total Draw Ratio=Draft Ratio (Φ)×First-step Draw Ratio×Multi-step Draw Ratio (Measurement of Branch)

The branch of an olefin polymer is determined by using 13 C-NMR (125 MHz). The measurement was performed using Randall's method described in Rev. Macromol. Chem. Phys., C29 (2&3), pp. 285-297.

Example 1

A high density polyethylene which had a weight-average molecular weight of 115,000 and a ratio of the weight-average molecular weight to a number-average molecular weight of 2.3 and contained branched chains with at least 5 carbon atoms in a number of 0.4 per 1,000 backbone carbon atoms was extruded through a spinneret having 390 holes with diameters of 0.8 mm so that the polyethylene could be discharged at 290° C. and at a rate of 0.5 g/min. per hole. The threadlike polyethylene extruded is allowed to pass through a thermally insulating zone with a length of 15 cm and then quenched at 20° C. and 0.5 m/s, and wound up at a speed of 300 m/min. This non-drawn filament was drawn with at least two sets of temperature controllable Nelson rollers. The drawing in the first stage was carried out at 25° C. to a length 2.8 times longer. The filament was further heated to 115° C. and was drawn to a length 5.0 times longer. The physical properties of the resultant drawn filament are shown in Table 1. In addition, the obtained filaments were knitted up with the circular knitting machine, and incision resistance was evaluated. The results are also shown in Table 1.

Example 2

The drawn filament of Example 1 was heated to 125° C. and was drawn to a length 1.3 times longer. The physical properties of the resultant filament are shown in Table 1. Similarly, the obtained filaments were knitted up with the circular knitting machine, and incision resistance was evaluated. The results are also shown in Table 1.

Comparative Examples 1-4

Physical properties of nylon filament, polyester filament, polyethylene filament and polypropylene filament commercially available are also shown in Table 1. Similarly, the filaments were knitted up with the circular knitting machine, and incision resistance was evaluated. The results are also shown in Table 1.

TABLE 1

| Experiment | Kind | Fineness (dtex) | Tenacity (cN/dtex) | Modulus (cN/dtex) | Index value |
|---|---|---|---|---|---|
| Example1 | The invention | 438 | 18.0 | 820 | 3.6 |
| Example2 | The invention | 336 | 19.1 | 890 | 3.8 |
| Comp. Example 1 | Nylon | 467 | 7.3 | 44 | 2.4 |
| Comp. Example 2 | Polyester | 444 | 7.4 | 106 | 2.5 |
| Comp. Example1 3 | Polyethylene | 425 | 7.1 | 129 | 2.2 |
| Comp. Example 4 | Polypropylene | 445 | 8.1 | 69 | 2.3 |

TABLE 2

| | Index value |
|---|---|
| Example 1 | 3.2 |
| Example 2 | 3.4 |
| Comp. Example 1 | 2.0 |
| Comp. Example 2 | 2.1 |
| Comp. Example 3 | 1.9 |
| Comp. Example 4 | 1.9 |

A glove was made by the known method using a knitting machine by using each of the base filament obtained in Example 1, 2 and Comparative Examples 1 to 4. The evaluation results of incision resistance are shown in Table 2. Compared with the filaments in Comparative Examples 1 to 4, the result that each of the filaments in Example 2 and 3 was excellent in incision resistance level was obtained.

Separated or collected to become 440 dtex±40 dtex as a whole, the filaments were made into flat-woven textile with a weave density of 40 per 25 mm in both of the longitudinal and latitudinal directions. The inner material of an incision resistant vest was made by cutting the resultant textile. The material was combined with the outer material to make an incision resistant vest. The incision resistance of the vest was evaluated and the good result was obtained.

Example 3

A high density polyethylene which had a weight-average molecular weight of 115,000 and a ratio of the weight-average molecular weight to a number-average molecular weight of 2.3 and contained branched chains with at least 5 carbon atoms in a number of 0.4 per 1,000 backbone carbon atoms was extruded through a spinneret having 390 holes with diameters of 0.8 mm so that the polyethylene could be discharged at 290° C. and at a rate of 0.5 g/min. per hole. The threadlike polyethylene extruded is allowed to pass through a thermally insulating zone with a length of 15 cm and then quenched at 20° C. and 0.5 m/s, and wound up at a speed of 300 m/min. This non-drawn filament was drawn with at least two sets of temperature controllable Nelson rollers. The drawing in the first stage was carried out at 25° C. to a length 2.8 times longer. The filament was further heated to 115° C. and was drawn to a length 5.0 times longer. The resultant filament had a breaking strength of a monofilament of 18.0 cN/dtex, a tensile modulus of 820 cN/dtex, and a monofilament fineness of 1.5 dtex. The cross-section shape of the resultant filament was round. This filament was cut into a length of 12 mm, and Dispersibility Evaluation for mortar premix and Bend Test for mortar were conducted. In addition, cured material which was formed by tying up the filaments to be 876 dtex to be cured with an epoxy resin (resin pickup of 71 wt %) was made for conducting Slump Test and Bend Test for Concrete.

Example 4

The drawn filament of Example 3 was heated to 125° C. and was drawn to a length 1.3 times longer. The resultant filament had a breaking strength of a monofilament of 19.1 cN/dtex, a tensile modulus of 890 cN/dtex, and a monofilament fineness of 1.4 dtex. The cross-section shape of the resultant filament was round. This filament was cut into a length of 12 mm, and Dispersibility Evaluation for mortar premix and Bend Test for mortar were conducted. In addition, cured material which was formed by tying up the filaments to be 672 dtex to be cured with an epoxy resin (resin pickup of 75 wt %) was made for conducting Slump Test and Bend Test for Concrete.

Comparative Example 5

As a filament, a polyethylene filament with ultra-high molecular weight, which had a breaking strength of a monofilament of 29.8 cN/dtex, a tensile modulus of 1008 cN/dtex, and a monofilament fineness of 1.2 dtex with an elliptical shape of 1:8 ratio at cross-section, was used. This filament was cut into a length of 12 mm, and Dispersibility Evaluation for mortar premix and Bend Test for mortar were conducted. In addition, cured material which was formed by curing the polyethylene filament with ultra-high molecular weight "880T" with an epoxy resin (resin pickup of 160 wt %) was made for conducting Slump Test and Bend Test for Concrete.

Comparative Example 6

As a filament, a polyvinylalcohol filament, which had a breaking strength of a monofilament of 7.5 cN/dtex, a tensile modulus of 240 cN/dtex, and a monofilament fineness of 378 dtex with a nearly round shape, was used. This filament was cut into a length of 6 mm, and Dispersibility Evaluation for mortar premix and Bend Test for mortar were conducted. In addition, a polyvinylalcohol filament, which had a breaking strength of 6.1 cN/dtex, a tensile modulus of 241.9 cN/dtex, and a fineness of 1650 dtex, was used for conducting Slump Test and Bend Test for Concrete.

The results from Dispersibility Evaluation for mortar premix, Bend Test for mortar, Slump Test and Bend Test for Concrete are shown in Table 3. The results in Table 3 indicate that an reinforcing effect with high tenacity is observed in the Bend Test for mortar since more filaments can be incorporated due to the high Dispersibility for mortar premix. In addition, it is found from the Slump Test and the Bend Test that high performance can be given in both of the maximum breaking load in the Bend Test and 2 mm—reduced flexural strength since a small resin pickup can be achieved as the result of the proper control on resin pickup.

TABLE 3

| | Evaluation for Mortar | Bend Test | | Bend Test or Concrete | |
|---|---|---|---|---|---|
| Test item Charasterics | premix Maximum fiber content (vol. %) | for Mortar Load value at 2 mm deflection ($N/mm^2$) | Test Slump Slump (cm) | Maximum flexeral strength ($N/mm^2$) | 2 mm - reduced flexeral strength ($N/mm^2$) |
| Example 3 | 1.6 | 13.4 | 10.5 | 7.29 | 5.05 |
| Example 4 | 1.4 | 12.9 | 8.5 | 7.55 | 5.25 |
| Comp. Example 5 | 0.9 | 6.1 | 11.0 | 7.38 | 4.99 |
| Comp. Example 6 | 2.1 | 10.5 | 14.5 | 6.21 | 3.21 |

Next, the features of a monofilament-type organic fiber which is based on the present filament to which covering is applied with a heat fusion fiber were compared between the results obtained by Example 5 and Comparative Example 7. The features were evaluated with Slump Test and Bend Test for Concrete.

Example 5

Covering was applied to the present filament obtained in Example 3 with a skin core-type heat fusion fiber which has a fineness of 190 T and is composed of polypropylene as a core and polyethylene as a shell. The resultant monofilament-type organic fiber was cut into a length of 30 mm, and the features were evaluated. In this case, the turn number of covering was 10 turns per 30 mm.

Comparative Example 7

Covering was applied to the polyethylene filament with ultra-high molecular weight used in Comparative Example 5, with a skin core-type heat fusion fiber which has a fineness of 190 T and is composed of polypropylene as a core and polyethylene as a shell. The resultant monofilament-type organic fiber was cut into a length of 30 mm, and the features were evaluated. In this case, the turn number of covering was 10 turns per 30 mm.

The results from Slump Test and Bend Test for Concrete are shown in Table 4. It is found from Table 4 that the slump loss becomes smaller.

TABLE 4

| | | Bend Test for Concrete | |
|---|---|---|---|
| Test item Charasterics | Slump Test Slump (cm) | Maximum flexeral strength ($N/mm^2$) | 2 mm - reduced flexeral strength ($N/mm^2$) |
| Example 5 | 3.5 | 6.72 | 4.21 |
| Comp. Example 7 | 0 | 6.89 | 4.44 |

Example 6

A high density polyethylene which had a weight-average molecular weight of 115,000 and a ratio of the weight-average molecular weight to a number-average molecular weight of 2.3 and contained branched chains with at least 5 carbon atoms in a number of 0.4 per 1,000 backbone carbon atoms was extruded through a spinneret having 390 holes with diameters of 0.8 mm so that the polyethylene could be discharged at 290° C. and at a rate of 0.5 g/min. per hole. The threadlike polyethylene extruded is allowed to pass through a thermally insulating zone with a length of 15 cm and then quenched at 20° C. and 0.5 m/s, and wound up at a speed of 300 m/min. This non-drawn filament was drawn with at least two sets of temperature controllable Nelson rollers. The drawing in the first stage was carried out at 25° C. to a length 2.8 times longer. The filament was further heated to 115° C. and was drawn to a length 5.0 times longer. The physical properties of the resultant drawn filament are shown in Table 5.

Example 7

The drawn filament of Example 6 was heated to 125° C. and was drawn to a length 1.3 times longer. The physical properties of the resultant filament are shown in Table 5.

Comparative Examples 8-11

Physical properties of nylon filament, polyester filament, polyethylene filament and polypropylene filament commercially available are also shown in Table 5.

TABLE 5

| Experiments | Kinds | Fineness (dtex) | Tenacity (cN/dtex) | Modulus (cN/dtex) | Specific gravity |
|---|---|---|---|---|---|
| Example 6 | The Invention | 438 | 18.0 | 820 | 0.97 |
| Example 7 | The Invention | 336 | 19.1 | 890 | 0.97 |
| Comp. Example 8 | Nylon | 467 | 7.3 | 44 | 1.14 |
| Comp. Example 9 | Polyester | 444 | 7.4 | 106 | 1.35 |
| Comp. Example 10 | Polyethylene | 425 | 7.1 | 129 | 0.96 |
| Comp. Example 11 | Polypropylene | 445 | 8.1 | 69 | 0.90 |

The filaments obtained in each of Example 6, 7 and Comparative Examples 8-11 were collected and twisted at the rate of 100 times per 1 m after adjusting the fineness. Using the resultant fiber as a base fiber, ropes with 6-strand laid having a thickness of about 10 mm Φ were made for model evaluation (wire rope structure) and various measurements were conducted. The evaluation results were shown in Table 6. It is found that each rope in the Examples is excellent in mechanical properties, high in wet performance and also high in strength per unit cross-sectional area, compared to each rope in the Comparative Examples.

TABLE 6

| | Rope diameter (mm) | Strength (ton) | Strength in wet condition (ton) | Strength per cross-sectional area ($ton/mm^2$) |
|---|---|---|---|---|
| Example 6 | 10 | 2.9 | 2.9 | 0.037 |
| Example 7 | 10 | 3.0 | 3.0 | 0.038 |
| Comp. Example 8 | 10 | 2.0 | 1.8 | 0.025 |
| Comp. Example 9 | 10 | 2.3 | 2.3 | 0.029 |
| Comp. Example 10 | 10 | 1.3 | 1.3 | 0.017 |
| Comp. Example 11 | 10 | 1.4 | 1.4 | 0.018 |

Example 8

A high density polyethylene which had a weight-average molecular weight of 115,000 and a ratio of the weight-average molecular weight to a number-average molecular weight of 2.8 was extruded through a spinneret having 30 holes with diameters of 0.8 mm so that the polyethylene could be discharged at 290° C. and at a rate of 0.5 g/min. per hole. The threadlike polyethylene extruded is allowed to pass through a thermally insulating zone with a length of 10 cm and then quenched at 20° C. and 0.5 m/s, and wound up at a speed of 500 m/min. This non-drawn filament was drawn with at least two sets of temperature controllable Nelson rollers. The drawing in the first stage was carried out at 25° C. to a length 2.0 times longer. The filament was further heated to 100° C. and was drawn to a length 6.0 times longer, so that the drawn filament with the total draw ratio of 4494 was produced. The physical properties of the resultant drawn filament are shown in Table 7. The rate of birefringence of the non-drawn filament was 0.021 in this case.

Example 9

The filament which was obtained by extruding and quenching the high density polyethylene used in Example 8 substantially in the same manner was wound up at a speed of 300 m/min. The drawing in the first stage was carried out at 25° C. to a length 2.0 times longer. The filament was then further heated to 100° C. and was drawn to a length 6.75 times longer, so that the drawn filament with the total draw ratio of 3033 was produced. The physical properties of the resultant drawn filament are shown in Table 7. The rate of birefringence of the non-drawn filament was 0.009 in this case.

Example 10

The filament which was obtained by extruding and quenching the high density polyethylene used in Example 8 substantially in the same manner was wound up at a speed of 400 m/min. The drawing in the first stage was carried out at 25° C. to a length 2.0 times longer. The filament was then further heated to 100° C. and was drawn to a length 6.5 times longer, so that the drawn filament with the total draw ratio of 3895 was produced. The physical properties of the resultant drawn filament are shown in Table 7. The rate of birefringence of the non-drawn filament was 0.015 in this case.

Example 11

A drawn filament with the total draw ratio of 4494 was produced substantially in the same manner as in Example 8, except that the drawing temperature in the first stage was changed to 10° C. The physical properties of the resultant filament are shown in Table 7.

Example 12

A drawn filament was produced substantially in the same manner as in Example 8, except that the drawing was carried out at 25° C. to a length 2.0 times longer in the first stage, at 100° C. to a length 3.0 times longer in the second stage, and at 130° C. to a length 2.5 times longer in the third stage, so that the drawn filament with the total draw ratio of 5618 was produced. The physical properties of the resultant filament are shown in Table 7.

Example 13

A high density polyethylene which had a weight-average molecular weight of 152,000 and a ratio of the weight-average molecular weight to a number-average molecular weight of 2.4 was extruded through a spinneret having 30 holes with diameters of 0.8 mm so that the polyethylene could be discharged at 300° C. and at a rate of 0.5 g/min. per hole. The filament which was quenched substantially in the same manner as in Example 8 was wound up at a speed of 200 m/min. This non-drawn filament was drawn at 25° C. to a length 2.0 times longer in the first stage. The filament was then further heated to 100° C. and was drawn to a length 6.0 times longer, so that the drawn filament with the total draw ratio of 4044 was produced. The physical properties of the resultant filament are shown in Table 7. The rate of birefringence of the non-drawn filament was 0.018 in this case.

Comparative Example 12

The filament which was obtained by extruding and quenching the high density polyethylene used in Example 8 substantially in the same manner was wound up at a speed of 100 m/min. The drawing in the first stage was carried out at 25° C. to a length 2.0 times longer. The filament was then further heated to 100° C. and was drawn to a length 7.0 times longer, so that the drawn filament with the total draw ratio of 1049 was produced. The physical properties of the resultant drawn filament are shown in Table 8. The rate of birefringence of the non-drawn filament was 0.002 in this case.

Comparative Example 13

A drawn filament with the total draw ratio of 4494 was produced substantially in the same manner as in Example 8, except that the drawing was carried out at 90° C. to a length 2.0 times longer in the first stage. The physical properties of the resultant filament are shown in Table 8.

Comparative Example 14

A high density polyethylene which had a weight-average molecular weight of 121,500 and a ratio of the weight-average molecular weight to a number-average molecular weight of 5.1 was extruded through a spinneret having 30 holes with diameters of 0.8 mm so that the polyethylene could be discharged at 270° C. and at a rate of 0.5 g/min. per hole. The filament was quenched substantially in the same manner as in Example 8. However, the filament was broken many times and only a non-drawn filament which was wound up at a speed of 300 m/min could be obtained. This non-drawn filament was drawn at 25° C. to a length 2.0 times longer in the first stage. The filament was then further heated to 100° C. and was drawn to a length 4.5 times longer, so that the drawn filament with the total draw ratio of 2022 was produced. The physical properties of the resultant filament are shown in Table 8. The rate of birefringence of the non-drawn filament was 0.030 in this case.

Comparative Example 15

A high density polyethylene which had a weight-average molecular weight of 55,000 and a ratio of the weight-average molecular weight to a number-average molecular weight of 2.3 was extruded through a spinneret having 30 holes with diameters of 0.8 mm so that the polyethylene could be discharged at 255° C. and at a rate of 0.5 g/min. per hole. The filament which was quenched in the same manner as in Example 8 substantially was wound up at a speed of 300 m/min. This non-drawn filament was drawn at 25° C. to a length 2.0 times longer in the first stage. The filament was then further heated to 100° C. and was drawn to a length 7.0 times longer, so that the drawn filament with the total draw ratio of 3146 was produced. The physical properties of the resultant filament are shown in Table 8. The rate of birefringence of the non-drawn filament was 0.008 in this case.

Comparative Example 16

The spinning was carried out by using a high density polyethylene which had a weight-average molecular weight of 82,000 and a ratio of the weight-average molecular weight to a number-average molecular weight of 2.5. However the polymer could not be extruded uniformly since the melt viscosity was too high.

TABLE 7

| | | Example 8 | Example 9 | Example 10 | Example 11 | Example 12 | Example 13 |
|---|---|---|---|---|---|---|---|
| Weight-average molecular weight(Polymer) | g/mol | 115,000 | 115,000 | 115,000 | 115,000 | 115,000 | 152,000 |
| Mw/Mn (Polymer) | — | 2.8 | 2.8 | 2.8 | 2.8 | 2.8 | 2.4 |
| Discharge amount from a single hole | g/min | 0.5 | 0.5 | 0.5 | 0.5 | 0.5 | 0.5 |
| Spinning speed | m/min | 500 | 300 | 400 | 500 | 500 | 200 |
| Draft ratio | — | 374.5 | 224.7 | 299.6 | 374.5 | 374.5 | 337 |
| Rate of birefringence | — | 0.021 | 0.009 | 0.015 | 0.021 | 0.021 | 0.018 |
| α-relaxation temperature | ° C. | 64 | 63 | 63 | 63 | 63 | 67 |
| Drawing temperature in the first stage | ° C. | 25 | 25 | 25 | 10 | 25 | 25 |
| Draw ratio in the 1st stage | — | 2.0 | 2.0 | 2.0 | 2.0 | 2.0 | 2.0 |
| Drawing temperature in the 2nd stage | ° C. | 100 | 100 | 100 | 100 | 100 | 100 |
| Draw ratio in the 2nd stage | — | 6.0 | 6.75 | 6.5 | 6.0 | 3.0 | 6.0 |
| Drawing temperature in the 3rd stage | ° C. | — | — | — | — | 130 | — |
| Draw ratio in the 3rd stage | — | — | — | — | — | 2.5 | — |
| Total draw ratio | — | 4494 | 3033 | 3895 | 4494 | 5618 | 4044 |
| Fineness | dtex | 26 | 39 | 36 | 36 | 26 | 62 |
| Tenacity | cN/dtex | 17.6 | 16.0 | 17.3 | 19.0 | 19.6 | 20.9 |
| Modulus | cN/dtex | 945 | 774 | 801 | 950 | 960 | 1023 |

TABLE 8

| | | Comp. Example 12 | Comp. Example 13 | Comp. Example 14 | Comp. Example 15 | Comp. Example 16 |
|---|---|---|---|---|---|---|
| Weight-average molecular weight(Polymer) | g/mol | 115,000 | 115,000 | 121,500 | 55,000 | 820,000 |
| Mw/Mn (Polymer) | — | 2.8 | 2.8 | 5.1 | 2.3 | 2.5 |
| Discharge amount from a single hole | g/min | 0.5 | 0.5 | 0.5 | 0.5 | — |
| Spinning speed | m/min | 100 | 500 | 300 | 300 | — |
| Draft ratio | — | 74.9 | 374.5 | 224.7 | 224.7 | — |
| Rate of birefringence | — | 0.002 | 0.021 | 0.030 | 0.008 | — |
| α-relaxation temperature | ° C. | 62 | 63 | 64 | 56 | — |
| Drawing temperature in the first stage | ° C. | 25 | 90 | 25 | 25 | — |
| Draw ratio in the 1st stage | — | 2.0 | 2.0 | 2.0 | 2.0 | — |
| Drawing temperature in the 2nd stage | ° C. | 100 | 100 | 100 | 100 | — |
| Draw ratio in the 2nd stage | — | 7.0 | 6.0 | 4.5 | 7.0 | — |
| Total draw ratio | — | 1049 | 4494 | 2022 | 3146 | — |
| Fineness | dtex | 107 | 26 | 56 | 36 | — |
| Tenacity | cN/dteX | 13.3 | 15.8 | 12.5 | 9.8 | — |
| Modulus | cN/dtex | 352 | 683 | 503 | 314 | — |

INDUSTRIAL APPLICABILITY

According to the present invention, in the case of producing a premix, a filament excellent in dispersibility can be obtained due to the cross-section shape of the filament, and a high tenacity can be given. Also, even in the case that a shape is formed to monofilament-type organic fibers by using a sizing agent, the invention enables the filament to give a high breaking load and a high tenacity and to reduce a slump loss.

In addition, according to the invention, a novel high strength polyolefin filament which has few falls of the performance by moisture absorption, water absorption etc. and thus has a high strength retention in a wet condition, and has a small diameter and a high tenacity, and does not form kinks, and is good in containment ability, which is most suitable for a variety of ropes for industrial use or consumer use such as ropes used in the marine industry, tethers, hawsers, yacht ropes, mountaineering ropes, various ropes for agricultural use, and various ropes for civil engineering, electric facilities or construction works, especially for use with circumferences of water in relation to marine vessels and marine industries, can be provided.

According to the invention, the novel high strength polyolefin filament can be produced efficiently.

The invention claimed is:

1. A process for producing a high strength polyolefin filament, comprising:

melt-extruding a non-drawn polyolefin filament without using a mixture of a polymer and a solvent for the polymer as a melt-extrusion material at a ratio of spinning speed to velocity of fluid product issuing from a spinneret of 100 or more;

drawing the non-drawn polyolefin filament at a temperature not higher than 65° C. to produce a high strength polyolefin filament, wherein the polyolefin of the non-drawn polyolefin filament is a polyethylene consisting essentially of ethylene and having a weight-average molecular weight of 60,000-300,000, and a ratio of a weight-average molecular weight to a number-average molecular weight (Mw/Mn) of 4.5 or less, and wherein the total draw ratio from spinning to drawing is 3,000 or more.

2. The process for producing a high strength polyolefin filament according to claim 1, further comprising:

drawing the drawn polyolefin filament further, subsequent to the drawing of the non-drawn polyolefin filament at a temperature not higher than the α-relaxation temperature of the non-drawn polyolefin filament, to produce the high strength polyolefin filament.

3. The process for producing a high strength polyolefin filament according to claim 1, further comprising:

quenching the melt-extruded non-drawn polyolefin filament with a cool air before the drawing of the non-drawn polyolefin filament.

4. The process for producing a high strength polyolefin filament according to claim 1, wherein the drawing of the non-drawn polyolefin filament is performed at a temperature which is at least 20 degree lower than an α-relaxation temperature of the non-drawn polyolefin filament.

5. The process for producing a high strength polyolefin filament according to claim 1, wherein the polyethylene of the non-drawn polyolefin filament has a rate of birefringence (Δn) of 0.008 or more.

6. A process for producing a high strength polyolefin filament, comprising:

melt-extruding a non-drawn polyolefin filament without using a mixture of a polymer and a solvent for the polymer as a melt-extrusion material at a ratio of spinning speed to velocity of fluid product issuing from a spinneret of 100 or more;

drawing the non-drawn polyolefin filament at below an α-relaxation temperature of the non-drawn polyolefin filament to produce a high strength polyolefin filament, wherein the polyolefin of the non-drawn polyolefin filament is a polyethylene consisting essentially of ethylene and having a weight-average molecular weight of 60,000-300,000, a ratio of a weight-average molecular weight to a number-average molecular weight (Mw/Mn) of 4.5 or less, and a rate of birefringence (Δn) of 0.008 or more, and wherein the total draw ratio from spinning to drawing is 3,000 or more.

7. The process for producing a high strength polyolefin filament according to claim 5, further comprising:

quenching the melt-extruded non-drawn polyolefin filament with a cool air before the drawing of the non-drawn polyolefin filament.

8. The process for producing a high strength polyolefin filament according to claim 7, wherein the drawing of the non-drawn polyolefin filament is performed at a temperature which is at least 20 degree lower than an α-relaxation temperature of the non-drawn polyolefin filament.

9. The process for producing a high strength polyolefin filament according to claim 6, wherein the drawing of the non-drawn polyolefin filament is performed at a temperature not higher than 65° C.

10. The process for producing a high strength polyolefin filament according to claim 9, further comprising:

further drawing the drawn polyolefin filament at a temperature which is higher than an α-relaxation temperature and lower than a melting point of the drawn polyolefin filament.

11. The process for producing a high strength polyolefin filament according to claim 10, wherein the further drawing of the drawn polyolefin filament is performed at a temperature of 90° C. or more.

12. A process for producing a high strength polyolefin filament, comprising:

melt-extruding a non-drawn polyethylene filament with a spinneret at a ratio of spinning speed to velocity of fluid product issuing from the spinneret of 100 or more;

drawing the non-drawn polyolefin filament at a temperature not higher than 65° C. into a drawn polyolefin filament to produce the high strength polyolefin filament, wherein the polyolefin of the non-drawn polyolefin filament is a polyethylene consisting essentially of ethylene and having a weight-average molecular weight of 60,000-300,000, a ratio of a weight-average molecular weight to a number-average molecular weight (Mw/Mn) of 4.5 or less, and a rate of birefringence (Δn) of 0.008 or more, and wherein the total draw ratio from spinning to drawing is 3,000 or more.

13. The process for producing a high strength polyolefin filament according to claim 12, wherein the melt-extruding of the non-drawn polyolefin filament involves melt-extruding a polyolefin melt-extrusion material that is not a mixture of a polymer and a solvent for the polymer.

14. The process for producing a high strength polyolefin filament according to claim 13, further comprising:

quenching the melt-extruded non-drawn polyolefin filament with a cool air and wounding the non-drawn polyolefin filament before the drawing of the non-drawn polyolefin filament.

15. The process for producing a high strength polyolefin filament according to claim 13, further comprising:

further drawing the drawn polyolefin filament at a temperature which is higher than an α-relaxation temperature and lower than a melting point of the drawn high strength polyolefin filament.

16. The process for producing a high strength polyolefin filament according to claim 15, wherein the further drawing of the drawn polyolefin filament involves further drawing the drawn filament at a temperature of 90° C. or more.

17. The process for producing a high strength polyolefin filament according to claim 16, wherein the drawing of the non-drawn polyolefin filament is performed at a temperature which is at least 20 degree lower than an α-relaxation temperature of the non-drawn polyolefin filament.

18. The process for producing a high strength polyolefin filament according to claim 16, wherein the drawing of the non-drawn polyolefin filament is performed at a temperature of about 25° C.

19. The process of producing a high strength polyethylene filament according to claim 1, wherein the total draw ratio from spinning to drawing is 3,895 times or more.

20. The process of producing a high strength polyethylene filament according to claim 6, wherein the total draw ratio from spinning to drawing is 3,895 times or more.

21. The process of producing a high strength polyethylene filament according to claim 12, wherein the total draw ratio from spinning to drawing is 3,895 times or more.

* * * * *